United States Patent [19]

Earle

[11] 4,259,761

[45] Apr. 7, 1981

[54] TOOTHBRUSH

[76] Inventor: Redmond B. Earle, 2575 W. 16th Ave., Vancouver, B.C., V6K 3B9, Canada

[21] Appl. No.: 911,479

[22] Filed: Jun. 1, 1978

[51] Int. Cl.[3] ..... A46B 5/02

[52] U.S. Cl. ..... 15/143 R; 15/167 R

[58] Field of Search ..... 15/167 R, 110, 143 R, 15/143 A, 143 B, 145

[56] References Cited

U.S. PATENT DOCUMENTS

| | | | |
|---|---|---|---|
| 2,835,912 | 5/1958 | Pensky | 15/167 R X |
| 3,968,950 | 7/1976 | Gallo | 15/167 R |

*Primary Examiner*—Peter Feldman

[57] ABSTRACT

A gripping construction of a toothbrush handle consisting of opposed substantially rectangular-block shaped flanges of approximate dimensions as of the dimensions of the handle in cross section and positioned about one third the distance from the brush head end (or about two and one half inches) and extending vertically and transversely at one hundred and eighty degrees to the top and bottom surfaces of the handle to form a cross-arm therewith whereby principally the side edges of the cross-arm and the front and back surfaces of the flanges allow the forefinger and thumb to press opposingly to effectively grip the brush for better manipulation of it.

1 Claim, 7 Drawing Figures

TOOTHBRUSH

BACKGROUND OF THE INVENTION

There is shown in U.S. Pat. No. 2,835,912 a toothbrush having opposed wing gripping extensions either mounted on the handle or formed integrally therewith and extending laterally to the side edges of the handle. Gripping is accomplished by having the thumb press the wings against the outside of the forefinger with the hand held in a fist-like position. It is the object of this invention to provide a more effective gripping construction of the handle of a toothbrush than that shown in the aforesaid patent, to provide a gripping construction having integrally moulded or mounted flanges supplant the wings shown in the aforesaid patent whereby uniquely the side edges and the front and back surfaces of the flanges principally are used for gripping the toothbrush handle, to provide a gripping construction of a toothbrush handle wherein the afore-mentioned flanges extend from different surfaces and in different directions than the aforesaid wings in the aforesaid patent, to provide a gripping construction of a toothbrush handle whereby the ends of the forefinger and thumb are used primarily to accomplish a more dextrous and firm and controlled brush manipulation, to provide a toothbrush handle gripping construction whereby the backs of the teeth are more easily brushed properly, and to provide a gripping construction of a toothbrush handle having either integrally-moulded or mounted flanges designed to be manufactured at low cost.

SUMMARY OF THE INVENTION

This invention relates to improvement in toothbrushes, and more particularly to an improvement in the handle of a toothbrush to enable better hand control of the brush to accomplish more proper and thorough cleaning of the teeth. My invention consists of rectangular-block shaped flanges of approximate dimensions as of the dimensions of the handle of the toothbrush in cross section either mounted on the handle or formed integrally therewith and positioned on the top and bottom surfaces of the handle about two and one half inches from the top of the toothbrush. The forefinger and thumb are easily placed on the various substantially flat and optionally smooth or serrated edges and surfaces of the flanges to bring about more managed application of pressure and more positively-controlled direction to a toothbrush for all of the tooth cleaning process. Proper vertical and circular brushing of all tooth surfaces is enhanced and particularly the backs of the teeth are more easily brushed better, accomplished by the flanges making possible more firmly-controlled forward and withdrawal stroking of this difficult to clean area.

For further comprehension of my invention description will now be given with reference to the drawings where like reference characters designate like parts throughout and wherein.

Figure 1:
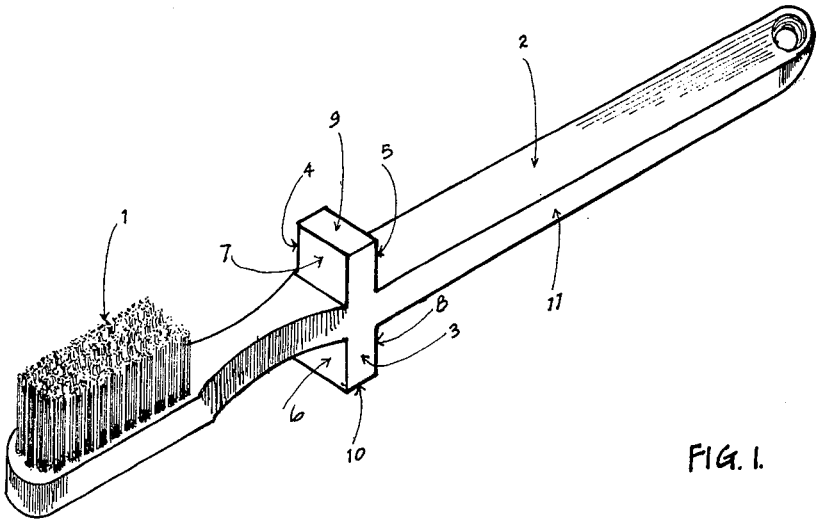
FIG. 1 is a perspective view showing integrally-moulded flanges on the handle of a toothbrush.
Figure 2:
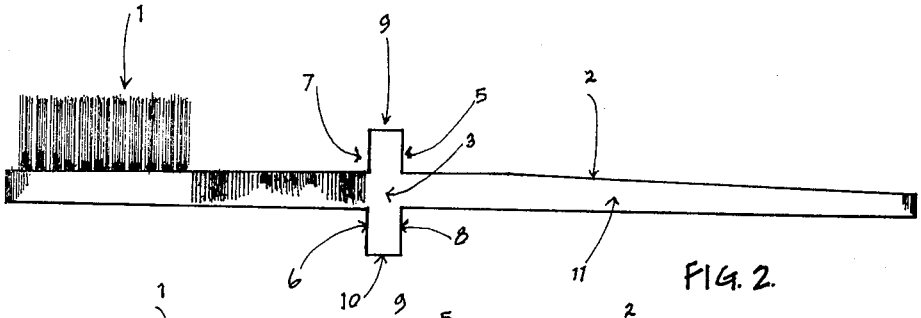
FIG. 2 is a side elevation view of FIG. 1.
Figure 3:
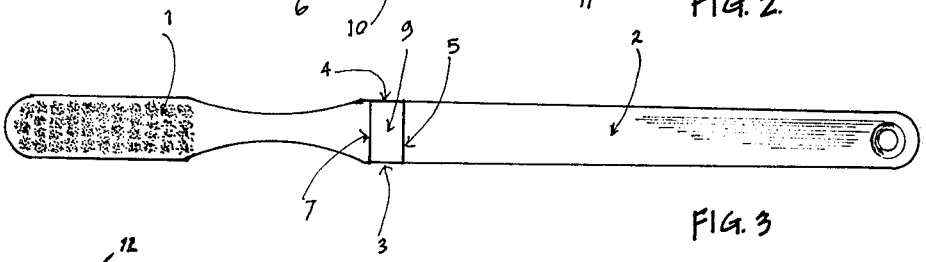
FIG. 3 is a top view of FIG. 1.
Figure 6:
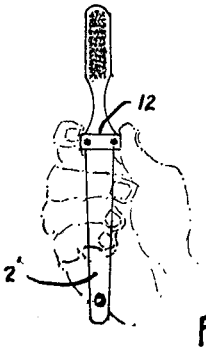
FIG. 6 is an illustration of the preferred method of holding the brush for cleaning the fronts of teeth.

Referring now to the drawings, which are a material part of this disclosure, and particularly to FIGS. 1, 2 and 3, it can be seen that the flanges 6,7 are vertical to and transverse at one hundred and eighty degrees the top and bottom surfaces 2,2 of the handle. The flange edges 3,4 and the edges of the handle 11 thus form a cross-arm right-angled to the surfaces of the handle. The ends of the forefinger and thumb placed on the side-edge planes 3,4 positions the brush for cleaning the fronts of teeth and the side edges 3,4 offer a central fulcrum between the flange extensions 11 giving leverage for controlled vertical, sweeping, and circular brush motion necessary for proper tooth-cleaning procedure. The substantially flat and sufficiently long and wide edges of the cross-arm 3,4 furnish focal areas against which the forefinger and thumb can press opposingly to accomplish a very firm gripping of the handle with the additional gripping of the long extension of the handle 2,11 in the palm of the hand gripped by the remaining fingers as illustrated in FIG. 6. The bristles 1 are presented easily and properly to the fronts of teeth because gripping is done primarily by the forefinger and thumb for the sides of the brush 3,4,11 rather than from the top and bottom surfaces of it. Brushing the fronts of teeth of the right and left sides of the jaw is accomplished by rotating the brush one half turn and reversing the positions of the forefinger and thumb on the right and left side edges 3,4 of the cross-arm FIG. 6.

Figure 7:
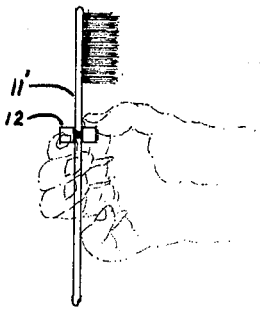
FIG. 7 is an illustration of the preferred method of holding the brush for cleaning the backs of teeth.

The backs of teeth are necessarily cleaned by the toe of the brush 1. For cleaning the backs of teeth of the lower jaw the outside of the forefinger end is pressed against the back surface 8 of the top flange and the end of the thumb is pressed opposingly against the front surface 7 of the bottom flange while the long extension of the handle 2,11 lies approximately across the mid-section of the palm side of the first three fingers and the outside of the little finger FIG. 7. One half rotation of the brush changes the surfaces against which the forefinger and thumb press 5,6 and positions the brush for cleaning the backs of teeth of the upper jaw.

While I have described the preferred hand positions for gripping my improved toothbrush handle, suitable for either hand, other combinations of edges 9,10 and surfaces of the flanges can be used for optional gripping positions.

Figure 4:
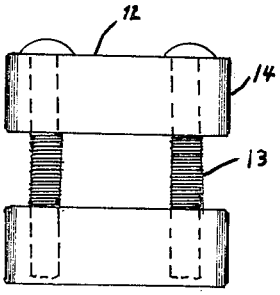
FIG. 4 is a front elevation view of an alternate embodiment showing removeable flanges that can be bolted to a toothbrush handle.
Figure 5:
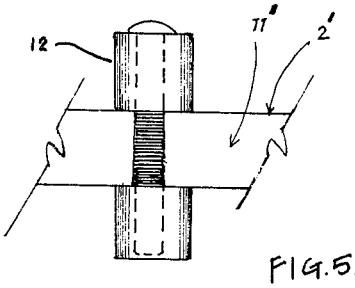
FIG. 5 is a side elevation view of FIG. 4 with the handle fragmentarily shown that can be bolted to a toothbrush handle.

Referring now to FIGS. 4 & 5 there are shown two equally dimensioned removeable flanges 12,12 that can be bolted to the handle 2',11' of a toothbrush. The toothbrush handle 2',11 ' FIG. 5 rests inside the fastening bolts 13 so that the ends 14 of the flanges, as shown in FIG. 4, form planes parallel to and raised from the side edge planes of the toothbrush handle so that a collar-like attachment results. These flanges are rectangular in cross section throughout their length and extend transverse to the longitudinal axis of the handle. Integrally moulded flanges illustrated in FIGS. 1,2,3 have flanges with side-edges 3,4 that are on the same plane as the side-edges of the toothbrush handle and it is understood that these moulded flanges could be fashioned to have side-edge planes 3,4 raised optionally from the side-edge planes of the toothbrush handle within the operational concept of my invention.

It should be understood that the present disclosure is for the purpose of illustration only and includes all modifications and improvements that fall within the scope of the appended claim.

I claim:

1. A toothbrush comprising an elongated handle and a bristle head, said handle having a longitudinal axis, said handle having a top surface, a bottom surface, and two edge surfaces and being substantially rectangular in cross-section, said handle having a removeable gripping section comprising two directly opposed flanges, each flange lying flatly on said top and bottom surfaces, respectively, each flange being equally dimensioned and being rectangular in cross-section throughout and extending transverse to the axis of the handle, bolt means on each end of said flanges for fixing said flanges to each other and to said handle, said flanges being fixed to said handle at about one third distance from the bristle head end of the toothbrush, whereby broad gripping surfaces are provided on the sides and ends of said flanges for the forefinger and thumb of the user.

* * * * *